US010174618B2

(12) United States Patent
Costamagna et al.

(10) Patent No.: US 10,174,618 B2
(45) Date of Patent: Jan. 8, 2019

(54) ROTOR FOR A TURBINE

(71) Applicant: Siemens Aktiengesellschaft, Munich (DE)

(72) Inventors: Karin Costamagna, Mulheim a.d. Ruhr (DE); Sascha Dungs, Wesel (DE); Harald Hoell, Wachtersbach (DE); Kevin Kampka, Mulheim a.d. Ruhr (DE); Karsten Kolk, Mulheim a.d. Ruhr (DE); Ulf Laudage, Essen (DE); Peter Schröder, Essen (DE); Vyacheslav Veitsman, Gelsenkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 395 days.

(21) Appl. No.: 14/899,171

(22) PCT Filed: Jun. 30, 2014

(86) PCT No.: PCT/EP2014/063812
§ 371 (c)(1),
(2) Date: Dec. 17, 2015

(87) PCT Pub. No.: WO2015/000830
PCT Pub. Date: Jan. 8, 2015

(65) Prior Publication Data

US 2016/0130948 A1 May 12, 2016

(30) Foreign Application Priority Data

Jul. 4, 2013 (DE) ..... 10 2013 213 115

(51) Int. Cl.
*F01D 5/06* (2006.01)
*F01D 5/02* (2006.01)
*F01D 5/10* (2006.01)

(52) U.S. Cl.
CPC ..... *F01D 5/066* (2013.01); *F01D 5/025* (2013.01); *F01D 5/026* (2013.01); *F01D 5/10* (2013.01);
(Continued)

(58) Field of Classification Search
CPC ..... F01D 5/066; F01D 5/025; F01D 5/026
See application file for complete search history.

(56) References Cited

U.S. PATENT DOCUMENTS 3,680,979 A 8/1972 Hansen et al.
4,247,256 A 1/1981 Maghon
(Continued)

FOREIGN PATENT DOCUMENTS

CN 101569989 A 11/2009
CN 101946072 A 1/2011
(Continued)

OTHER PUBLICATIONS

CN Office Action dated Feb. 4, 2017, for CN patent application No. 201480038127.0.
(Continued)

*Primary Examiner* — Logan M Kraft
*Assistant Examiner* — John S Hunter, Jr.
(74) *Attorney, Agent, or Firm* — Beusse Wolter Sanks & Marie

(57) ABSTRACT

A rotor for a turbine has a plurality of rotor components lined up in the axial direction and connected by a connecting rod, wherein a groove which extends in the circumferential direction and is open in the axial direction is disposed on one of the rotor components, wherein a coupling element running around the connecting rod in order to support the connecting rod is disposed in the groove. The rotor is adapted to enable particularly stable support of the connecting rod in order to prevent vibrations. The coupling element
(Continued)

is disposed on a retaining element connected to the connecting rod.

12 Claims, 2 Drawing Sheets

(52) U.S. Cl.
CPC ..... *F05D 2220/32* (2013.01); *F05D 2230/60* (2013.01); *F05D 2240/24* (2013.01); *F05D 2240/60* (2013.01); *F05D 2260/30* (2013.01)

(56) References Cited

U.S. PATENT DOCUMENTS

| | | | |
|---|---|---|---|
| 5,537,814 | A | 7/1996 | Nastuk et al. |
| 5,865,600 | A | 2/1999 | Mori et al. |
| 2003/0217548 | A1 | 11/2003 | Sekihara et al. |
| 2006/0013693 | A1 | 1/2006 | Meacham et al. |
| 2007/0286733 | A1 | 12/2007 | Bouchard |
| 2009/0265908 | A1 | 10/2009 | Corn et al. |
| 2010/0296926 | A1 | 11/2010 | Arase et al. |
| 2011/0146298 | A1 | 6/2011 | Reinhardt et al. |
| 2014/0150248 | A1 | 6/2014 | Corn et al. |

FOREIGN PATENT DOCUMENTS

| | | | |
|---|---|---|---|
| DE | 2135088 | A1 | 4/1972 |
| EP | 2565387 | A1 | 3/2013 |
| GB | 858763 | A | 1/1961 |
| GB | 2339858 | B | 4/2002 |
| JP | S34011701 | U | 6/1955 |
| JP | S5939903 | A | 3/1984 |
| JP | H09133005 | | 5/1997 |
| JP | H09317406 | A | 12/1997 |
| WO | 2008012195 | A1 | 1/2008 |
| WO | 2012052965 | A1 | 4/2012 |

OTHER PUBLICATIONS

JP Office Action dated Dec. 5, 2016, for JP patent application No. 2016-522557.

CN Office Action dated Nov. 30, 2016, for CN patent application No. 201480051795.7.

ROTOR FOR A TURBINE

CROSS REFERENCE TO RELATED APPLICATIONS

This application is the U.S. National Stage of International Application No. PCT/EP2014/063812 filed Jun. 30, 2014, and claims the benefit thereof. The International Application claims the benefit of German Application No. DE 102013213115.1 filed Jul. 4, 2013. All of the applications are incorporated by reference herein in their entirety.

FIELD OF INVENTION

The invention relates to a rotor for a turbine, comprising a number of rotor components arranged in a row in the axial direction and connected by means of a tie rod, wherein in one of the rotor components there is arranged a groove extending in the circumferential direction and open in the axial direction, wherein a coupling element surrounding the tie rod is arranged in the groove to brace the tie rod.

BACKGROUND OF INVENTION

A turbine is a fluid flow machine, which converts the internal energy (enthalpy) of a flowing fluid (liquid or gas) into rotational energy and ultimately into mechanical drive energy. A proportion of the fluid stream's internal energy is removed therefrom by the maximally eddy-free, laminar flow around the turbine blades and passes to the rotor blades of the turbine. This then sets the turbine shaft in rotation, and the useful power is output to a coupled-on working machine, such as for example a generator. The rotor blades and shaft are parts of the mobile turbine rotor or wheel, which is arranged within a housing.

As a rule, a plurality of blades are mounted on the shaft. Rotor blades mounted in a plane in each case form a blade wheel or impeller. The blades have a slightly curved profile, similar to an aircraft wing. A stator is conventionally located upstream of each impeller. The stator guide vanes protrude from the housing into the flowing medium and cause it to swirl. The swirl (kinetic energy) produced in the stator is used in the subsequent impeller to set in rotation the shaft on which the impeller blades are mounted. The stator and impeller together are known as a stage. A plurality of such stages are often connected in series.

The rotor of a turbine is as a rule held together in the axial direction by means of a tie rod. The individual rotor components such as turbine wheel disks, rotor disks and hollow shafts are arranged in a row and clamped by a tie rod. The rotor disks are here connected together interlockingly by Hirth toothing, such that torque may be transferred between the individual elements.

To reduce oscillation of the tie rod, the tie rod is in this case held by bracing means which are inserted in the various compressor and turbine wheel disks and in the cooling air separation tube. To this end, annular, conically bevelled coupling elements are conventionally provided, which engage in a groove introduced into the respective rotor component, said groove extending in the circumferential direction and being open in the axial direction. The coupling elements are here heated on assembly, so that they are connected by shrink fit in the groove of the respective rotor component such as for example a wheel disk. Due to the conical shape, the coupling elements enclose the tie rod flush at their smallest diameter and likewise exhibit a shrink fit at this point.

However, with the known bracing means an additional axial securing component is typically necessary to prevent any possible axial travel. For example, the retaining elements must always be placed between two disks. Despite these measures, the risk of a temporary, transient loss of contact still exists.

It is moreover known from DE 2 135 088 A1 to secure the tie rod of a rotor of a fluid flow machine relative to an outer casing by way of a circumferentially toothed pair of bushes.

In addition, US 2007/0286733 A1 discloses thermal separation of rotor disks and tie rod of a gas turbine. To this end, an insulation ring and two spacer segments inserted from radially outside are arranged between the last rotor disk and the end of the tie rod. To secure the latter against loss caused by centrifugal force, a sleeve is put over the insulation ring and the spacer elements, which sleeve is in turn secured by a split ring against axial displacement. A disadvantage here is that the tie rod is not braced between its two ends and is thus capable of oscillating.

SUMMARY OF INVENTION

It is therefore an object of the invention to provide a rotor of the above-stated type which uses technically simple means to achieve particularly stable bracing of the tie rod to prevent oscillations.

Said object is achieved according to the invention by arranging the coupling element serving in radial bracing of the tie rod relative to the other rotor components on a retaining element connected to the tie rod.

The invention is here based on the consideration that particularly stable bracing of the tie rod would be possible if fixing of the coupling element, i.e. of the part engaging in the groove in the respective rotor component, were no longer ensured solely by shrinking on and thus via noninterlocking connection to the tie rod itself. Rather, an interlocking connection should be provided instead. This is achievable using technically simple means, if retaining elements connected to the tie rod are provided thereon, the coupling element being arranged on said retaining elements.

In one advantageous configuration, the coupling element is of annular construction. This gives rise to bracing of the tie rod which is particularly simple to produce and assemble. Because the coupling element is arranged on a separate retaining element on the tie rod, a cone shape is also no longer essential; rather, the coupling element may form a ring in the form of a simple cylinder surface.

The groove in the respective rotor component is advantageously constructed to extend completely around the tie rod. Thus, if the coupling element has a simple annular shape it may lie in the groove over the complete circumference, so improving stability.

In a further advantageous configuration, a second circumferentially extending groove open in the axial direction towards the first groove is arranged in the respective retaining element, the coupling element engaging in said second groove. In other words: the groove in the retaining element is axially opposite the groove in the respective rotor component. The annular coupling element thus engages on a first axial side in the groove in the rotor component, and on the other axial side in the groove in the retaining element.

Advantageously, a plurality of retaining elements is here arranged over the circumference of the tie rod. The number of retaining elements may then be adapted in line with requirements: the more retaining elements are provided, the better is the bracing of the tie rod. A smaller number of retaining elements may however be advantageous with regard to weight and complexity of assembly.

In a particularly simple advantageous configuration, the respective retaining element is a nut screwed together with the tie rod. This further simplifies assembly: for this purpose it is merely necessary to fit threads to the tie rod which project out of the tie rod in the radial direction. Nuts may then be screwed in the above-described form onto these threads, said nuts then acting as retaining elements to retain the coupling elements and thus brace the tie rod.

In a method for producing a rotor as described, coupling element and/or retaining element are fitted in a preheated state. This simplifies assembly. After cooling of the elements, a shrink fit is established, which firmly stabilizes the tie rod. Of particular advantage is the fact that, on shrinkage, the groove in the retaining element is displaced towards the axis of the tie rod and thus an offset arises relative to the groove in the respective rotor component. In conjunction with the reduction on cooling of the diameter of the coupling element, pretension thus arises, which counteracts the centrifugal force arising on operation and thus enables particularly stable retention.

A turbine advantageously comprises a rotor as described.

The turbine here advantageously takes the form of a gas turbine. It is precisely in gas turbines that the thermal and mechanical loads are particularly high, such that the described configuration of the tie rod bracing offers particular advantages with regard to stability.

A power plant advantageously comprises such a turbine.

The advantages achieved with the invention consist in particular in that, by bracing the tie rod not by shrinking the coupling element onto the tie rod itself, but rather by securing to a separate retaining element on the tie rod, oscillation of the tie rod can be prevented in a particularly stable and technically simple manner. In addition, internal supply of cooling air is enabled in combination with bracing of the tie rod, since passages remain between the retaining elements. Tie rod bracing is achieved without any need for additional axial securing components. The risk of a temporary, transient loss of contact is eliminated.

BRIEF DESCRIPTION OF THE DRAWINGS

An exemplary embodiment of the invention is explained in greater detail below with reference to drawings, in which.

DETAILED DESCRIPTION OF INVENTION

Figure 1:
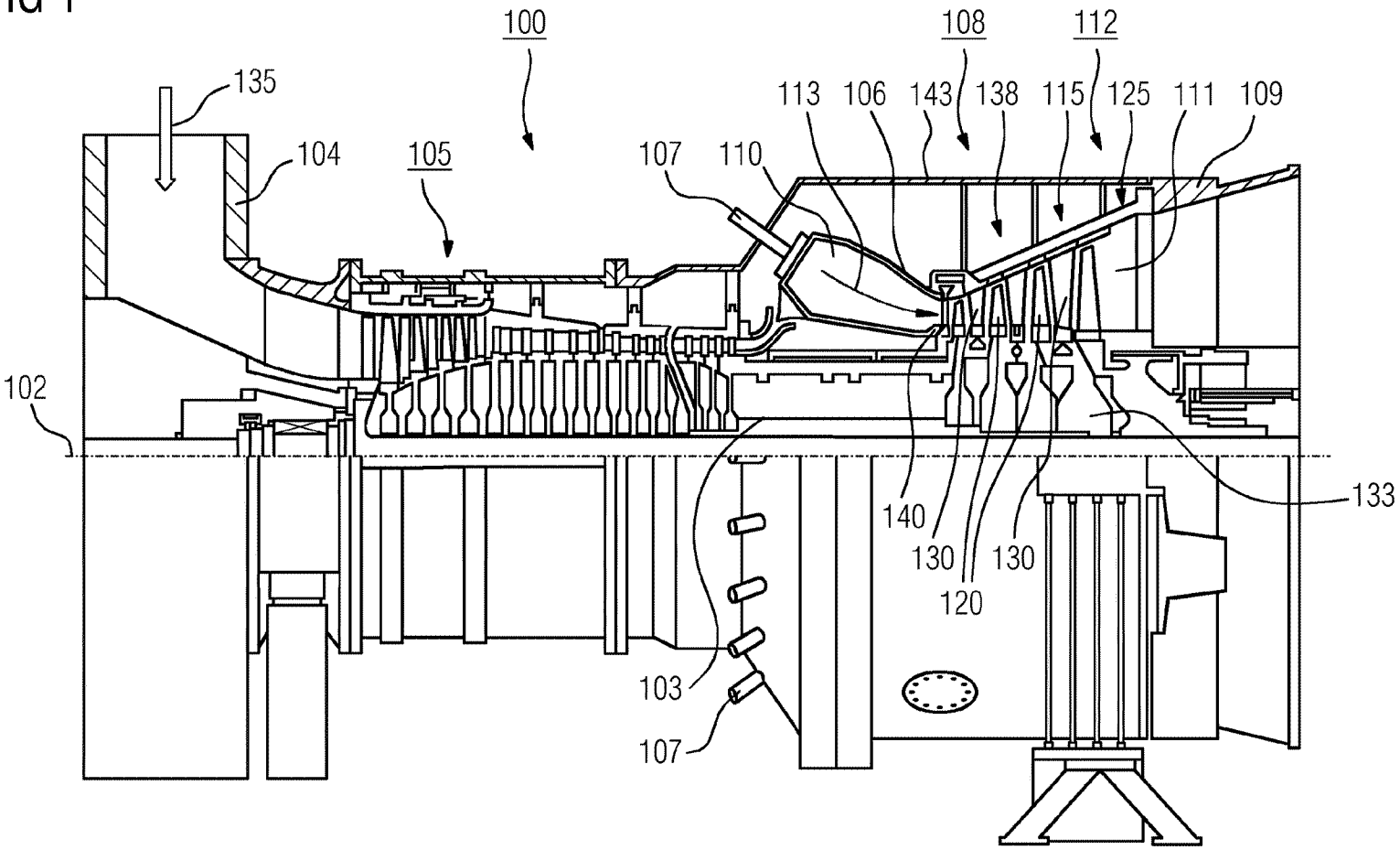
FIG. 1 shows a partial longitudinal section through a gas turbine.

Identical parts are provided with the same reference numerals in all the figures.

FIG. 1 shows a turbine 100, here a gas turbine, in partial longitudinal section. The gas turbine 100 comprises in its interior a rotor 103 which is mounted to rotate about an axis of rotation (102) (axial direction) and is also known as a turbine wheel. The following follow one another along the rotor 103: an intake housing 104, a compressor 105, a toroidal combustion chamber 110, in particular annular combustion chamber 106, with a plurality of coaxially arranged burners 107, a turbine 108 and the waste gas housing 109. The annular combustion chamber 106 communicates with an annular hot gas duct 111. There for example four series-connected turbine stages 112 form the turbine 108. Each turbine stage 112 is formed from two rings of blades and vanes. Viewed in the direction of flow of a working medium 113, a row 125 formed of rotor blades 120 follows a row of stator guide vanes 115 in the hot gas duct 111. The stator guide vanes 130 are in this case fastened to the stator 143, whereas the rotor blades 120 of a row 125 are mounted on the rotor 103 by means of a turbine disk 133. The rotor blades 120 thus form constituents of the rotor or turbine wheel 103. A generator or a machine (not shown) is coupled to the rotor 103. During operation of the gas turbine 100, air 135 is drawn in by the compressor 105 through the intake housing 104 and compressed. The compressed air provided at the turbine-side end of the compressor 105 is guided to the burners 107 and there is mixed with a fuel. The mixture is then combusted in the combustion chamber 110, forming the working medium 113. The working medium 113 flows from there along the hot gas duct 111 past the stator guide vanes 130 and the rotor blades 120. At the rotor blades 120 the working medium 113 expands in a pulse-transmitting manner, such that the rotor blades 120 drive the rotor 103 and the latter drives the working machine coupled thereto.

The components exposed to the hot working medium 113 are subject to thermal loads during operation of the gas turbine 100. Along with the heat shield bricks lining the annular combustion chamber 106, the stator guide vanes 130 and rotor blades 120 of the turbine stage 112 which comes first when viewed in the direction of flow of the working medium 113 are subject to the most thermal load. To withstand the temperatures prevailing there, these are cooled by means of a coolant. Likewise, the blades and vanes 120, 130 may have coatings to withstand corrosion (MCrAlX; M=Fe, Co, Ni, rare earths) and heat (thermal barrier layer, for example $ZrO_2$, $Y_2O_4$—$ZrO_2$).

Each stator guide vane 130 comprises a guide vane root (not shown here) facing the inner housing 138 of the turbine 108 and a guide vane tip opposite the guide vane root. The guide vane tip faces the rotor 103 and is fixed to a sealing ring 140 of the stator 143. Each sealing ring 140 here surrounds the shaft of the rotor 103. The turbine disks 133, and further components not described in any greater detail, such as hollow shafts, are connected to the rotor 103 via a tie rod 144. To prevent oscillation of the tie rod 144, the latter is braced on the rotor components, as illustrated in the schematic diagram in FIG. 2.

Figure 2:
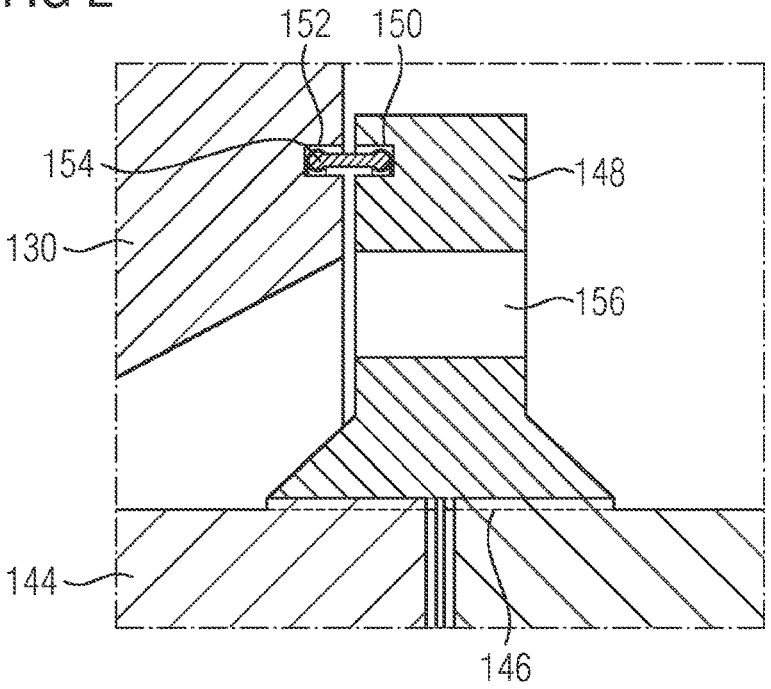
FIG. 2 is a schematic diagram of tie rod bracing.

FIG. 2 shows a longitudinal section (relative to the axis 102) through the tie rod 144 at the radial outer edge thereof. Introduced into the tie rod 144 is a thread 146 which projects radially out of the tie rod 144. A nut 148 is screwed onto the thread 146 as a retaining element. Similar combinations of thread 146 and nut 148 are arranged at regular intervals over the circumference of the tie rod 144.

The nut 148 comprises a groove 150, which is open in the axial direction and faces the turbine disk 133. Opposite the groove 150 a further groove 152 is introduced into the turbine disk 133, extending around the entire circumference. An annular coupling element is arranged in the two grooves 150, 152 in the manner of a tongue and groove joint and thereby fixes the tie rod 144 in the radial direction. In the axial direction the turbine disk 133 is fixed by way of the tension of the tie rod 144, while the nut 148 is fixed via the thread 146. Corresponding bracing means may be provided on each rotor component in different axial regions of the tie rod 144. The nut 148 comprises a central opening 156 passing through it in the axial direction. Cooling air may pass through this opening 156, as between the individual nuts 148, so enabling internal cool air conduction for cooling the tie rod 144.

Figure 3:
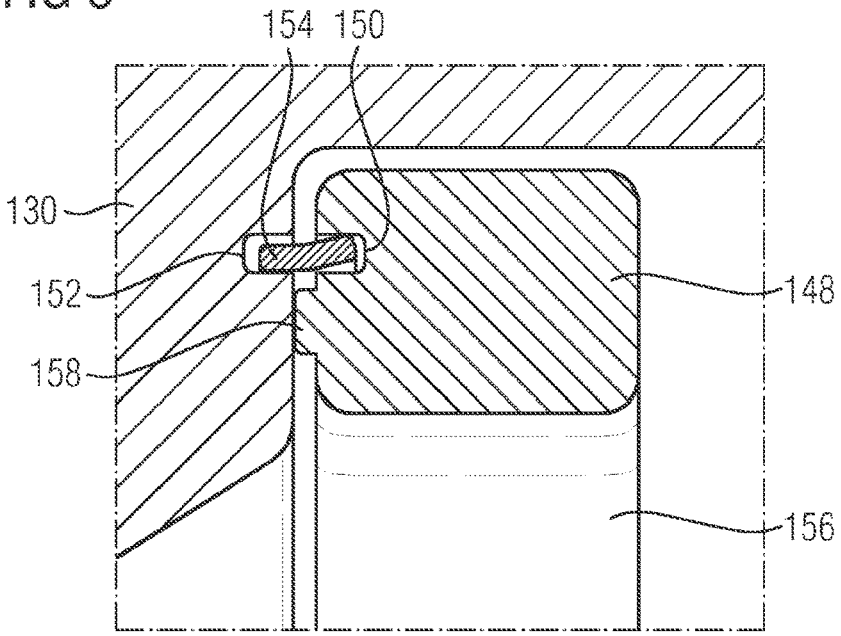
FIG. 3 shows a longitudinal section through the tie rod bracing in the region of the grooves.

FIG. 3 shows a detail of a longitudinal section of the region around the coupling element 154. The nut 148 here additionally comprises a projection 158 which rests against the turbine disk 133 and brings about stabilization in the axial direction.

During assembly, nut 148 and coupling element 154 are heated. On cooling, nut 148 and coupling element 154 therefore shrink, such that the coupling element 154 and groove 150 are moved towards the axis 102. In this way, the coupling element 154 rests on the radial inner side of the groove 152 in the turbine disk 133 and on the radial outer side of the groove 150 in the nut 148. This results in pretension, which counteracts the centrifugal force arising during operation.

The invention claimed is:

1. A rotor for a turbine, comprising a number of rotor components arranged in a row and connected by a tie rod, wherein in one rotor component of the number of rotor components there is arranged a first groove that comprises an annular shape that extends circumferentially completely around the tie rod and that is open in an axial direction relative to a tie rod longitudinal axis, wherein a coupling element surrounding the tie rod is arranged in the first groove for oscillation-preventing radial bracing of the tie rod, and wherein the coupling element is arranged on a retaining element that is connected to the tie rod.

2. The rotor as claimed in claim 1, wherein the coupling element comprises an annular body.

3. The rotor as claimed in claim 1, further comprising:

a second circumferentially extending groove open in the axial direction towards the first groove arranged in the retaining element, the coupling element engaging in said second circumferentially extending groove.

4. The rotor as claimed in claim 1, further comprising:

a plurality of retaining elements arranged over a circumference of the tie rod.

5. The rotor as claimed in claim 1, wherein the retaining element is a nut screwed together with the tie rod.

6. A turbine comprising:

the rotor as claimed in claim 1.

7. The turbine as claimed in claim 6, wherein the turbine comprises a gas turbine.

8. A power plant comprising:

the turbine as claimed in claim 6.

9. A method for producing a rotor, the method comprising:

assembling a coupling element and/or a retaining element in a preheated state, wherein the rotor comprises a number of rotor components arranged in a row and connected by a tie rod, wherein in one rotor component of the number of rotor components there is arranged a first groove extending in a circumferential direction relative to a tie rod longitudinal axis and open in an axial direction relative to the tie rod longitudinal axis, wherein the coupling element surrounding the tie rod is arranged in the first groove for oscillation-preventing radial bracing of the tie rod, and wherein the coupling element is arranged on the retaining element that is connected to the tie rod.

10. A turbine comprising:

the rotor produced by the method of claim 9.

11. A turbine rotor, comprising:

a rotor disk disposed on a tie rod and comprising a disk face that faces axially with respect to a tie rod longitudinal axis and a first groove that is recessed into the disk face and comprises a shape which is elongated circumferentially completely around the tie rod longitudinal axis, a retaining nut secured to the tie rod and through which the tie rod fully passes, the retaining nut comprising a retaining nut face that faces the disk face and a second groove that is recessed into the retaining nut face and which comprises a shape that extends circumferentially around the tie rod longitudinal axis, and a coupling element comprising an annular body, the coupling element positioned within the first groove and the second groove, wherein the coupling element limits radial movement of the retaining nut relative to the rotor disk, thereby limiting radial oscillation of the tie rod.

12. The turbine rotor of claim 11, wherein the retaining nut comprises a central opening therethrough to receive the tie rod, and further comprises an axially oriented air opening therethrough axially aligned with and radially offset from the central opening.

* * * * *